US008241233B2

(12) United States Patent
Litton et al.

(10) Patent No.: US 8,241,233 B2
(45) Date of Patent: Aug. 14, 2012

(54) MANUAL DEVICE FOR MASSAGING APPENDAGE MUSCLES

(76) Inventors: Kevin Scott Litton, Sapporo (JP); Jonathan Scott Walsh, Sapporo (JP)

( * ) Notice: Subject to any disclaimer, the term of this patent is extended or adjusted under 35 U.S.C. 154(b) by 954 days.

(21) Appl. No.: 12/286,209

(22) Filed: Sep. 30, 2008

(65) Prior Publication Data

US 2009/0112136 A1 Apr. 30, 2009

Related U.S. Application Data

(60) Provisional application No. 61/000,196, filed on Oct. 25, 2007.

(51) Int. Cl.
*A61H 23/00* (2006.01)

(52) U.S. Cl. ..... 601/151; 601/133; 601/148

(58) Field of Classification Search ..... 601/41–44, 601/133–135, 148–151, DIG. 20; 606/201, 606/202, 203
See application file for complete search history.

(56) References Cited

U.S. PATENT DOCUMENTS

| | | | | |
|---|---|---|---|---|
| 4,770,164 | A * | 9/1988 | Lach et al. | 601/41 |
| 6,325,771 | B1 * | 12/2001 | Kelly et al. | 601/41 |
| 6,676,613 | B2 * | 1/2004 | Cantrell et al. | 601/41 |
| 6,736,785 | B1 * | 5/2004 | Van Brunt | 601/44 |
| 2003/0004445 | A1 * | 1/2003 | Hall et al. | 601/41 |
| 2006/0074362 | A1 * | 4/2006 | Rousso et al. | 601/152 |
| 2010/0256540 | A1 * | 10/2010 | Yamashiro et al. | 601/44 |

* cited by examiner

*Primary Examiner* — Quang D Thanh
(74) *Attorney, Agent, or Firm* — Bay State IP, LLC; Adam J. Bruno; Janine D. Geraigery

(57) ABSTRACT

A portable, manual massage device for massaging appendage muscles, having a wrap with vertical edges and a gap defined between the vertical edges. The vertical edges have at least one anchor and are bound by at least one tension transfer member located between the vertical edges. The tension transfer members are encircled with springs between the vertical edges and enclosed by an external tension-transfer guide and an internal tension-transfer guide. The external tension-transfer guide integrally couples between an actuator and the wrap and the internal tension-transfer guide integrally couples between the anchors.

22 Claims, 9 Drawing Sheets

MANUAL DEVICE FOR MASSAGING APPENDAGE MUSCLES

CROSS-REFERENCE TO RELATED APPLICATION

This application claims the benefit of provisional patent application Ser. No. U.S. 61/000,196 filed Oct. 25, 2007 by the present inventors, which is incorporated by reference.

BACKGROUND OF THE INVENTION

The invention relates to a massaging device, and more particularly, to a personal, manual massaging device for appendage muscles comprised of a wrap, wherein the wrap having vertical edges separated by a gap is bound by at least one tension transfer member enclosed by internal and external tension-transfer guides, the tension transfer member is encircled with springs between the vertical edges, and the external tension-transfer guide is connected to an actuator, and a method of massaging appendage muscles using the manual device.

Muscle tension is caused from a variety of sources, such as, extreme or fast bodily movement, strain on muscle use, stress, injury or trauma to the body, etc. Muscle tension can also be caused by internal complications such as decreased blood flow, damage to the blood vessel walls, infections or muscular imbalance. No matter the cause, muscle tension can be extremely painful for an individual.

Muscle tension can often feel like the muscles are always tight or strained, sometimes to the point of frequent pain, or even persistent and ongoing pain. Some individuals may also find the pain so restricting and debilitating that it prevents physical activity, and sometimes to the point of becoming bed ridden. Muscle cramps, or muscle spasms, are strong, painful contractions. They can occur in virtually any muscle but are most common in the calf and foot.

Muscle massaging devices to relieve tension are extremely popular, and there are many variations in the marketplace. The vast majority of these devices are for the neck and back. These devices either rest on top of the back or neck muscles or require rubbing an ointment into the skin.

One main solution for relieving muscle tension is to apply pressure to the sore muscle area. This helps relieve throbbing or aching which are often the symptoms of muscle tension. Contracting and expanding of the muscles also helps to increase blood flow through the muscles, thereby allowing the constant contraction of the muscle itself to subside.

The present invention seeks to provide a portable, easy to use device for massaging appendage muscles. The present invention is a low-cost product and allows for multiple embodiments which can allow a user to operate the device either by hand or by foot. The wrap allows the device to be used on a plurality of body parts thereby decreasing ongoing muscle tension.

DESCRIPTION OF THE RELATED ART

Previously, many massaging devices have been introduced that are portable and easy to use, many of which can be found in stores or on websites that sell personal care products. However, especially with the condition called Deep Vein Thrombosis (commonly referred to as Economy Class Syndrome) on the rise, there is a need for a portable, easy to use device for appendage muscles, such as the calf muscle.

One commonly used device for appendage muscles is the compression stocking, which is a static device, as opposed to one which contracts and expands, and thus not a true massaging device.

Another concept is a portable device which works by sending electrical impulses to stimulate the muscle. This, again, is not a true massaging device. It also requires electricity, in the form of a battery, which can be inconvenient for many people, and the device may cost more than someone other than those already afflicted with deep vein thrombosis or at a high risk for this condition may be willing to spend.

Still another concept is a massaging device which requires a bladder filled with liquid or air with a pump to inflate and deflate the bladder at intervals to provide the massaging effect. However, most are cumbersome devices which are not portable and are cost prohibitive except for use in clinical environments. Even those which claim to be portable are so only in a loose definition of the word portable. These are also medical devices, rather expensive, and are primarily for those people already with deep vein thrombosis or those with a high risk of this condition.

SUMMARY OF THE INVENTION

It is an object of the invention to provide a portable, manual, non-electric device for massaging appendage muscles. Accordingly, the present device is made from lightweight materials, is small in size and easy to carry, and requires no electrical inputs.

It is an object of the invention to provide a massaging device which does not require the use of batteries. Accordingly, the present device is manually operated and has no battery compartment or need for a battery to relieve muscle tension in a body part.

It is an object of the invention to provide a massaging device which is easy to use. Accordingly, the present device requires the user to simply encircle the desired body part with the wrap and apply compressions to the actuator to relieve muscle tension in the body part.

It is an object of the invention to provide a low cost massaging device in manufacturing and a low-cost end product. Accordingly, the present device is manufactured using simple materials and parts which are readily available.

It is an object of the invention to provide a massaging device for applying pressure to aching muscles. Accordingly, the tension-transfer members of the present device constrict the wrap around a body part to relieve muscle tension.

It is an object of the invention to provide a massaging device for contracting and expanding around a body part. Accordingly, the present device allows the user to compress and decompress the actuator which retracts and releases, respectively, the tension-transfer member and thereby contracts and expands the wrap around the body part to relieve muscle tension.

It is an object of the invention to provide a massaging device capable of use on multiple body parts. Accordingly, the wrap of the present device can be made of multiple materials and various sizes so as to obtain the desired size for the aching body part.

It is an object of the invention to provide a massaging device capable of manual operation by either hand or foot. Accordingly, the actuator of the present device can be a mechanism similar to a hand brake or a foot pedal for applying pressure to the desired body part by the user.

It is an object of the invention to provide a massaging device which is comfortable while in use. Accordingly, in the present device a protective flap is positioned under the tension-transfer members and springs so as to avoid abrasion between the springs and operators skin.

The invention is a portable, manual massage device for massaging appendage muscles, having a wrap with vertical edges and a gap defined between the vertical edges. The vertical edges have at least one anchor and are bound by at least one tension transfer member located between the vertical edges. The tension transfer members are encircled with springs between the vertical edges and enclosed by an external tension-transfer guide and an internal tension-transfer guide. The external tension-transfer guide integrally couples between an actuator and the wrap and the internal tension-transfer guide integrally couples between the anchors.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 5A illustrates a single tension-transfer member and protruding members.

FIG. 5B illustrates a single tension-transfer member and actuator.

DRAWING REFERENCE NUMERALS

Figure 1A:
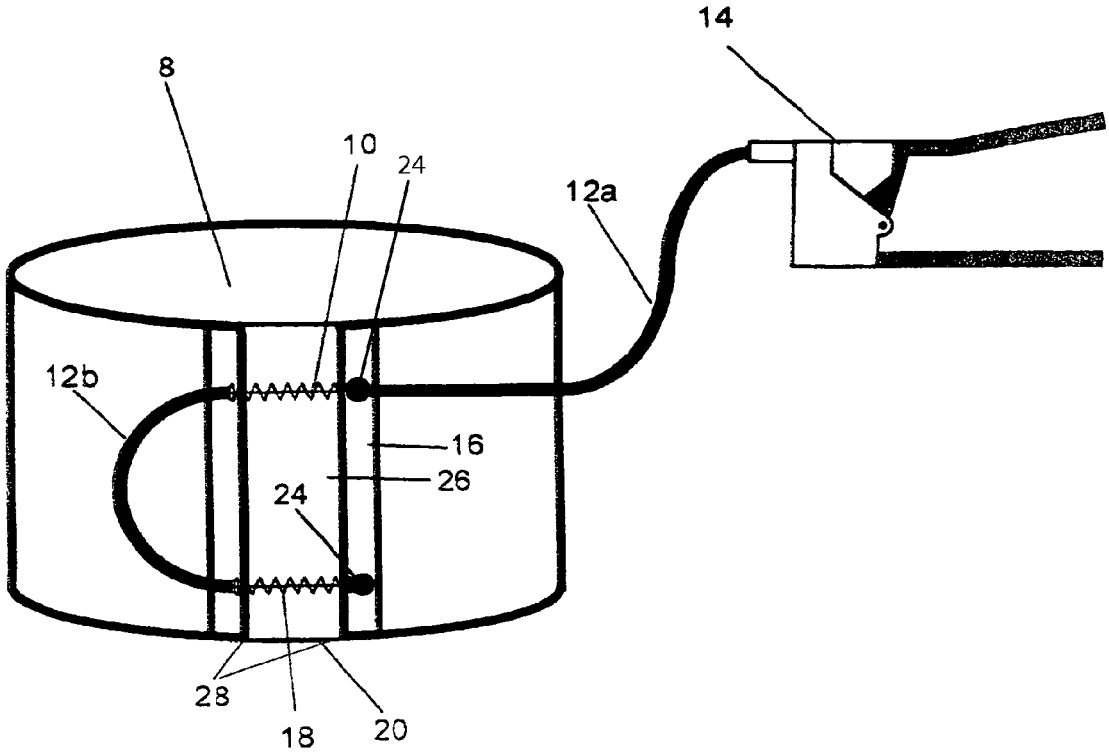
FIGS. 1A-B are side views of the preferred embodiment of the massaging device, illustrating one tension-transfer member, one external tension-transfer guide, one internal tension-transfer guide, and two springs.

8 wrap
10 tension-transfer member/cable
12*a* external tension-transfer member guide
12*b* internal tension-transfer member guide
14 manual retracting device/actuator
16 wrap supporter
18 spring
20 protective flap
22 protruding member
24 anchor
26 gap
28 vertical edges

DETAILED DESCRIPTION OF THE PREFERRED EMBODIMENTS

FIG. 1 illustrates the massaging device in the preferred embodiment. The massaging device has a wrap 8 made of a soft, flexible material, preferably nylon. It is possible for the wrap 8 to be made of a variety of materials, such as, canvas, polyester, or the like. The wrap 8 can also be made of semi-soft material, such as rubber or leather, or a hard material, such as metal or plastic. For wraps 8 made of soft or semi-soft materials, one or more straight or curved wrap supporters 16 can be attached to the vertical edges 28 of the wrap 8 along the vertical axis to allow for even compression and to prevent the wrap 8 to "pucker" along the vertical edges 28.

The wrap 8 has vertical edges 28 and a gap 26 defined by the vertical edges 28 which allows the wrap 8 to be constricted. The size of the gap 26 is preferably two to three centimeters, but can be varied. The vertical edges 28 of the wrap 8 are bound by a tension-transfer member 10. Preferably, the tension-transfer member 10 is a thin cable, but wire, string, lace, or the like are suitable materials. The wrap 8 is constricted or compressed by one or more of the tension-transfer members 10. The tension-transfer member 10 is enclosed in an external tension-transfer guide 12*a* and an internal tension transfer guide 12*b* which are in communication with the wrap 8. The tension-transfer member 10 is encircled by two springs 18 positioned between the vertical edges 28 which allow the wrap 8 to toggle between a constricted and an un-constricted position.

The external tension-transfer guide 12*a* integrally couples to an actuator 14 and holds the tension between the actuator 14 and the wrap 8. The internal tension-transfer guide 12*b* integrally couples between the two springs 18 of the tension-transfer member 10 and the anchors 24 located along the vertical edges 28. The internal tension-transfer guide holds the tension between the anchors 24.

In the preferred embodiment, the springs 18 encircle the tension-transfer member 10, however, other positions of the springs between the vertical edges 28 are contemplated. Preferably, the anchors 24 are separate members which hold the external tension-transfer guide and internal tension-transfer guide, 12*a* and 12*b*, respectively, in place while allowing the tension transfer-member 10 to move freely. Anchors 24 may be created by other means, such as, glue or sewing, or the like. A protective flap 20 can be positioned between the springs 18 and the skin of the body part of the user so as to avoid abrasions between the skin, pants or the like, of the user and the springs 18.

The actuator 14 is a mechanism similar to a hand-brake and allows the wrap 8 to be either positioned in a constricted or un-constricted state by either compressing the actuator 14 to retract the tension-transfer member 10 and cause the springs 18 to coil or decompressing the actuator 14 and allowing the springs 18 to uncoil and push the wrap 8 back to the open position.

The first step in using the massaging device is placing a body part such as a limb or appendage in the wrap 8 by allowing the gap 26 to be in the open position. Next, by compressing the actuator 14, the tension-transfer member 10 constricts the wrap 8 around the body part by retracting and bringing the vertical edges 28 towards each other and minimizing the gap 26. The user then releases the actuator 14, releasing tension in the springs 18 and in the tension-transfer member 10. As tension is released, the vertical edges 28 are separated and the gap 26 is returned to the open position. The springs 18 push the wrap 8 completely back to its un-constricted position upon release of the actuator 14. These steps are repeated to produce a massaging effect and relieve muscle tension in the desired body part.

Figure 1B:
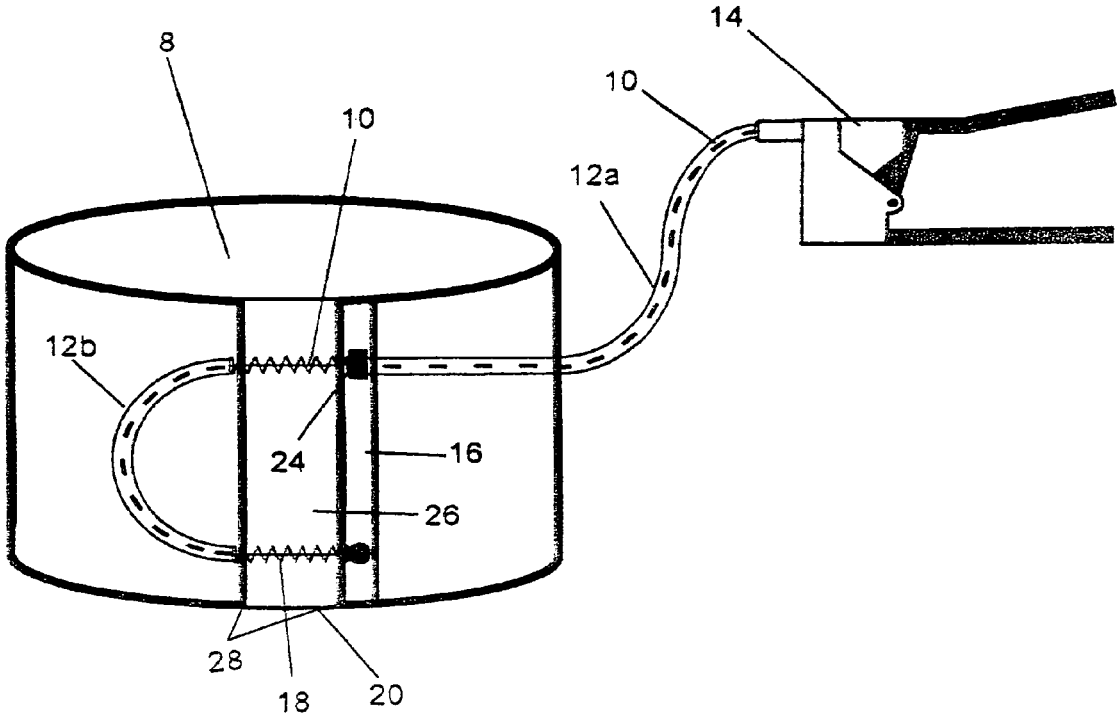

FIG. 1B illustrates the external tension-transfer guide 12*a* and internal tension-transfer guide 12*b* in the preferred embodiment as hollow sleeves or tubes. Other embodiments are contemplated which allow the tension-transfer member 10 to pass through the external and internal tension-transfer guides 12*a*, 12*b*.

Figure 2A:
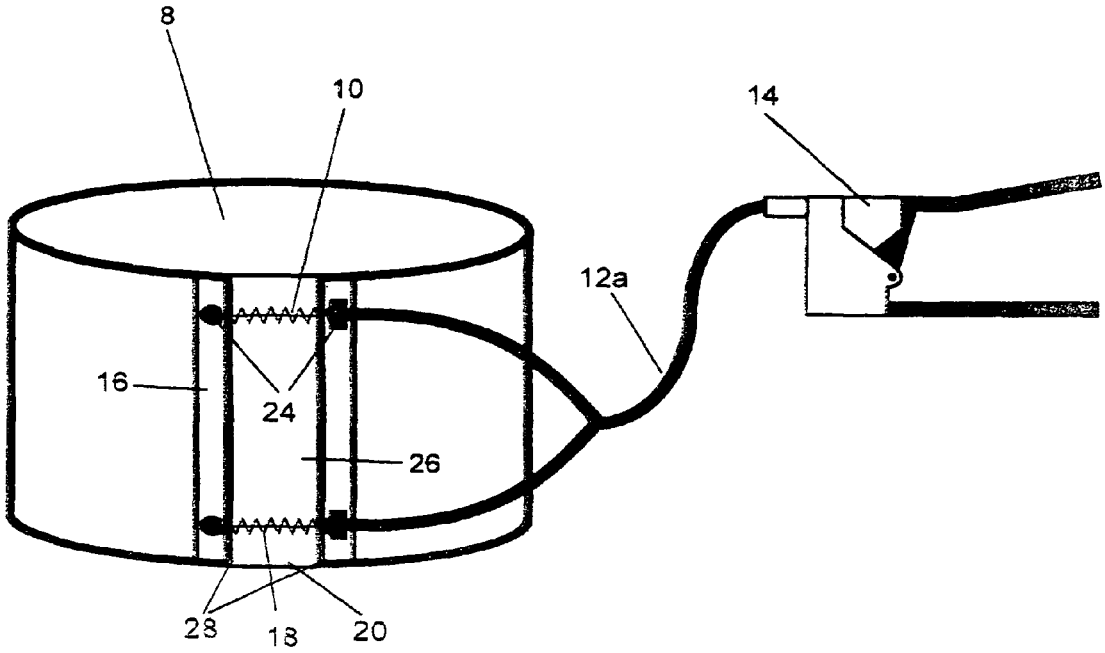
FIGS. 2A-B are side views of a second embodiment of the massaging device, illustrating a split external tension-transfer guide.
Figure 2B:
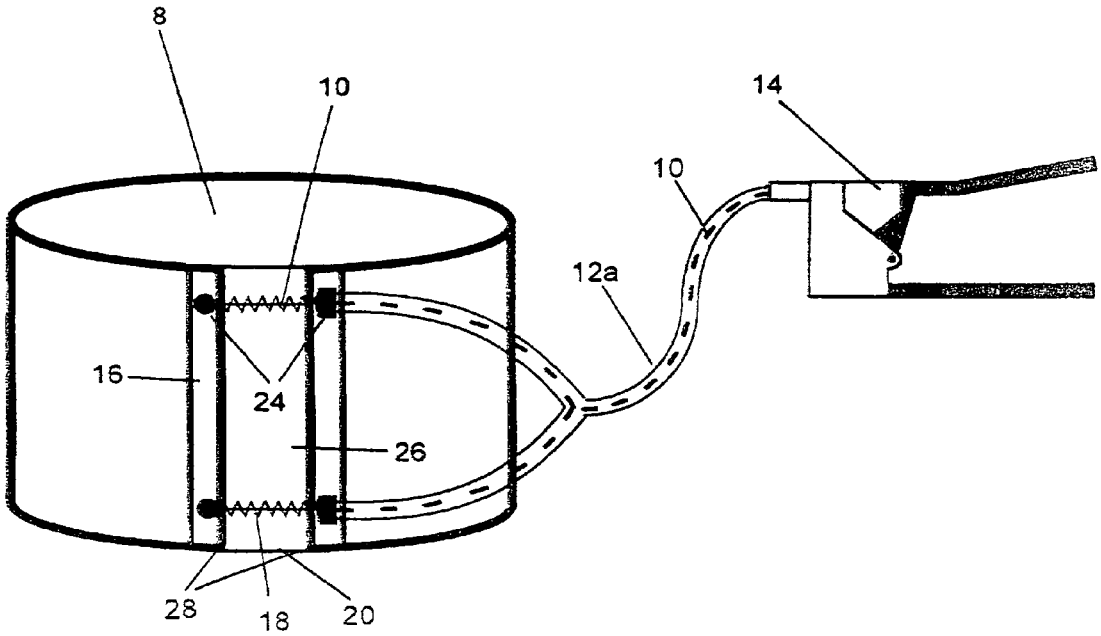

FIGS. 2A-2B illustrate an alternative embodiment of the massaging device in which the external tension-transfer guide 12*a* is split into two tension-transfer members 10. In this embodiment, each tension-transfer member 10 is encircled by a spring 18 between the vertical edges 28. Each end of the external tension-transfer guide 12*a* integrally couples to anchors 24 on the vertical edges 28 of the wrap 8. In this alternative embodiment no internal tension-transfer guide is present and the wrap 8 continues to operate as intended to effectively massage appendage muscles.

Figure 3:
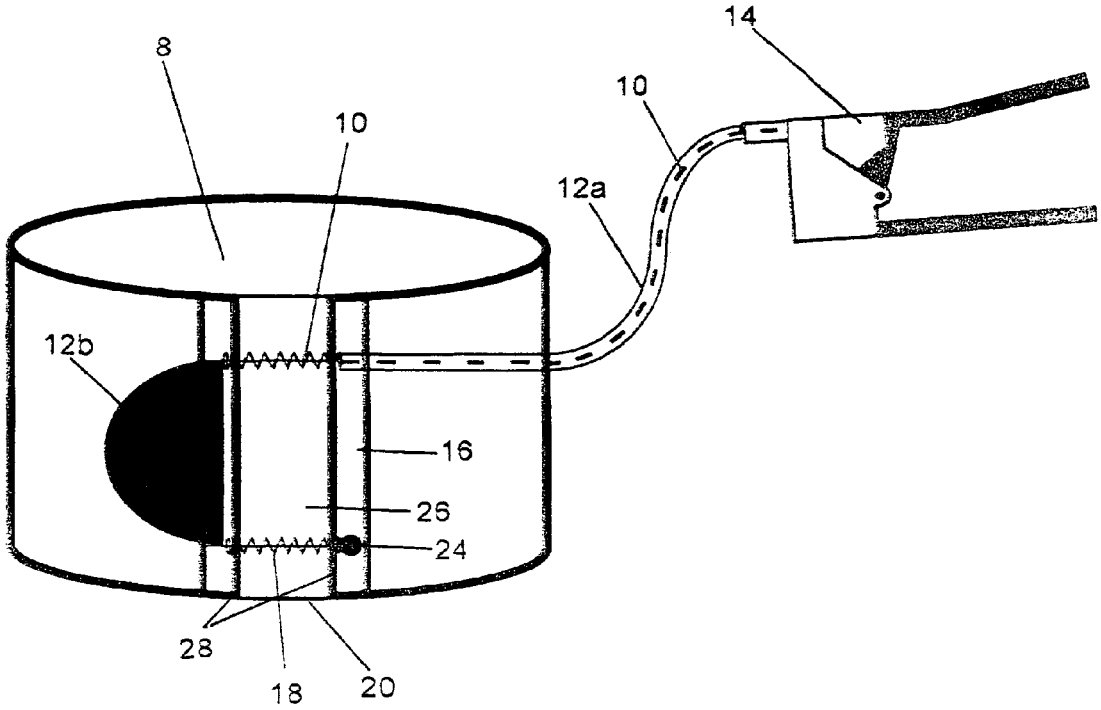
FIG. 3 is a side view of a third embodiment the massage device, illustrating a solid grooved internal tension-transfer guide.

FIG. 3 illustrates an alternative embodiment of the massaging device in which the internal tension-transfer guide 12*b* is a solid piece with a groove along the edge to allow the tension-transfer member 10 to slide freely. In this embodiment, the tension-transfer member 10 integrally couples to the anchors 24 located on the vertical edges 28 of the wrap 8, and the compression from the actuator 14 guides the anchor 24 to constrict the gap 26 when in the compressed, closed position. The internal tension-transfer guide 12*b* can be made of any hard or soft material which does not constrict lateral movement.

Figure 4:
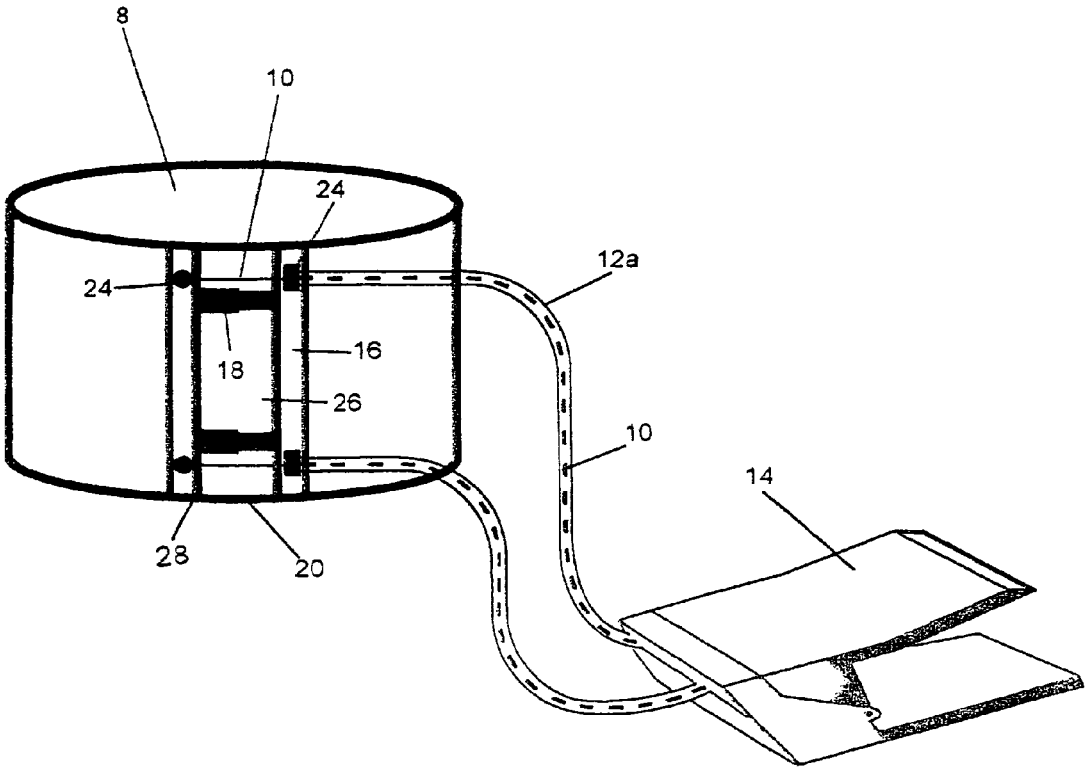
FIG. 4 is side view of a fourth embodiment of the massaging device, illustrating two cables, two separate external tension-transfer guides, a completely encircling wrap, springs adjacent to the tension-transfer member, and an actuator which can be operated by foot.

FIG. 4 illustrates a further alternative embodiment of the massaging device in which two tension-transfer members 10 are used, each enclosed by an external tension-transfer guide 12*a*. In this embodiment, the wrap 8 encircles the body part, and the springs 18 are adjacent to the tension-transfer members 10 but integrally couple to the vertical edges 28. The tension-transfer members 10 integrally couple to the anchors 24. In this embodiment the actuator 14 is a flat object which can be operated by the user's foot.

Figure 5A:
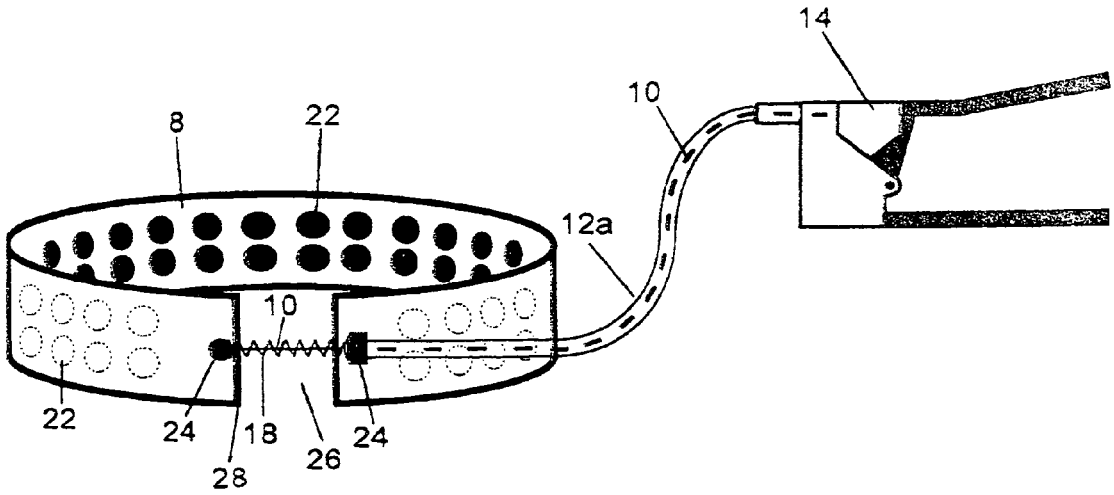
FIGS. 5A-B are side views of a fifth embodiment of the massaging device, illustrating the wrap as a slimmer band.

FIG. 5A illustrates an alternative embodiment of the massaging device in which the wrap 8 is slimmer in size. In this embodiment, only one tension-transfer member 10 is contemplated with one spring 18 encircling the tension-transfer member 10. In this embodiment, the wrap 8 has protruding members 22 located on the inside of the wrap 8 to provide the user a deeper massage to relieve muscle tension. The protruding members 22 can vary in number, size and shape to achieve the desired massaging effects.

Figure 5B:
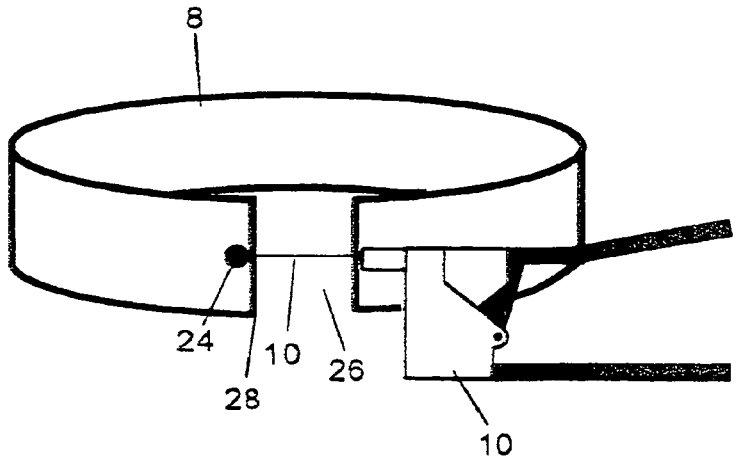

FIG. 5B illustrates an alternative embodiment of the massaging device with only one tension-transfer member 10 and no external tension-transfer guide 12*a* or springs 18. The tension-transfer member 10 integrally couples between an anchor 24 on the vertical edge 28 and the actuator 14.

Figure 6:
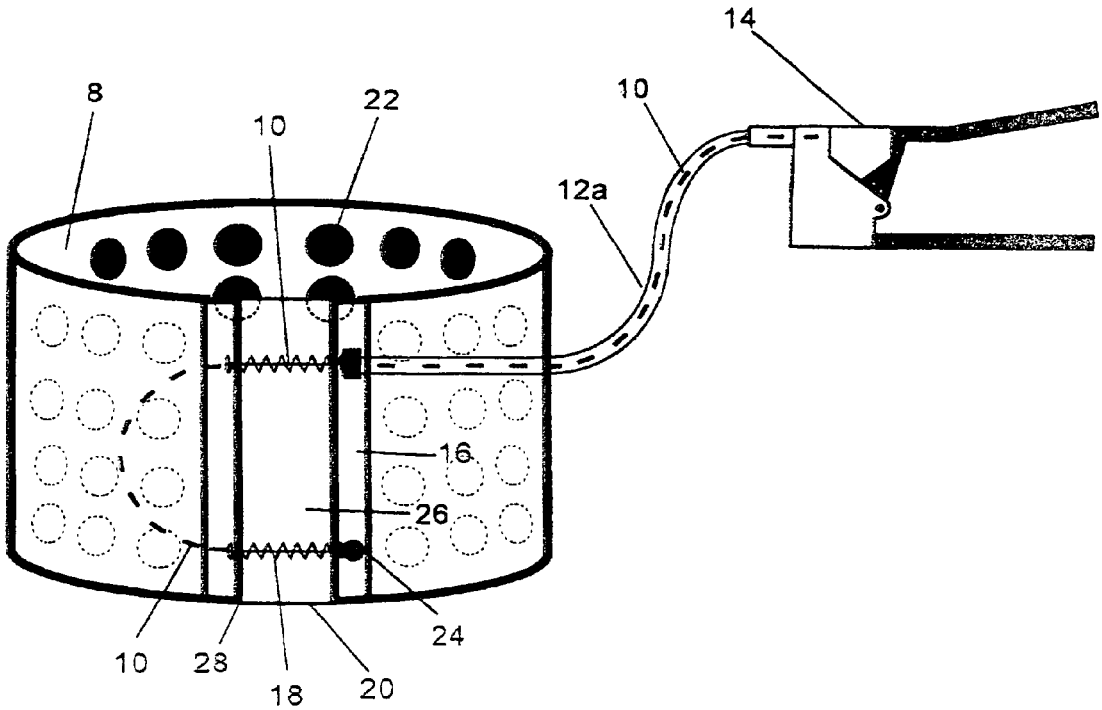
FIG. 6 is a side view of a sixth embodiment of the massaging device, illustrating the tension transfer member encased within the wrap without the need for an internal tension-transfer guide.

FIG. 6 illustrates an alternative embodiment of the massaging device in which no internal tension transfer guide 12*a* is contemplated. The tension-transfer member 10 is encased within the wrap 8 between the two springs 18.

In conclusion, presented herein is a manual device for massaging appendage muscles, and a method of using the same. The invention is illustrated by example in the drawing figures, and throughout the written description. It should be understood that numerous variations are possible, while adhering to the inventive concept. Such variations are contemplated as being a part of the present invention.

What is claimed is:

1. A portable, manual massage device for massaging appendage muscles comprising:

a wrap having vertical edges, a gap defined between said vertical edges, wherein said vertical edges having at least one anchor;

at least one tension-transfer member;

a means for retracting said tension-transfer member;

at least one spring, wherein said spring encircles said tension-transfer member between said vertical edges; and at least one external tension-transfer guide, wherein said external tension-transfer guide encloses said tension-transfer member and is in communication with said means for retracting said tension-transfer member and said wrap.

2. A method for massaging appendage muscles of claim 1, comprising the steps of:

(a) placing a body part into the wrap by allowing the gap to be in an open position;

(b) minimizing the gap by compressing said means for retracting said tension-transfer member and retracting the tension-transfer member to define a closed position by the wrap around the body part;

(c) returning the wrap to the open position by releasing said means for retracting said tension-transfer member; and (d) repeating steps (b) through (c) until release of muscle tension in the body part is achieved.

3. The portable, manual massage device of claim 1, further comprising at least one internal tension-transfer guide and at least two anchors, wherein said internal tension-transfer guide encloses said tension-transfer member and is in communication with said anchors.

4. The portable, manual massage device of claim 3, wherein said internal tension-transfer guide further comprises a solid piece having an edge and at least one groove along said edge.

5. The portable, manual massage device of claim 1, wherein said means for retracting said tension-transfer member is an actuator.

6. The portable, manual massage device of claim 5, wherein said actuator is hand operated.

7. The portable, manual massage device of claim 5, wherein said actuator is foot operated.

8. The portable, manual massage device of claim 1, having two springs and having four anchors, wherein said springs are in communication with said anchors.

9. The portable, manual massage device of claim 1, having two external tension-transfer guides wherein said external tension-transfer guides extend from said wrap, said external tension-transfer guides converge into a single external tension-transfer guide, which is in communication with said means for retracting said tension-transfer member.

10. The portable, manual massage device of claim 1, wherein said spring is adjacent to said tension-transfer member.

11. The portable, manual massage device of claim 1, wherein the wrap further comprises at least one protruding member.

12. The portable, manual massage device of claim 1, wherein the wrap further comprises a protective flap.

13. The portable, manual massage device of claim 1, wherein said wrap is made from soft or semi-soft material, said vertical edges having one or more straight or curved wrap supporters.

14. A portable, manual massage device for massaging appendage muscles comprising:

a wrap having vertical edges, a gap defined between said vertical edges, wherein said vertical edges having at least one anchor;

at least one tension-transfer member;

an actuator for retracting said tension-transfer member;

at least one spring, wherein said spring encircles said tension-transfer member between said vertical edges;

at least one external tension-transfer guide, wherein said external tension-transfer guide encloses said tension-transfer member and is in communication with said actuator and said wrap; and at least one internal tension-transfer guide, wherein said internal tension-transfer guide encloses said tension-transfer member and is in communication with said at least one anchor and a second anchor.

15. The portable, manual massage device of claim 14, wherein the internal tension-transfer guide comprises a solid piece having at least one groove along the edge.

16. The portable, manual massage device of claim 14, wherein said actuator is hand operated.

17. The portable, manual massage device of claim 14, wherein said actuator is foot operated.

18. The portable, manual massage device of claim 14, having two springs and having four anchors, wherein each one said springs is in communication with a pair of said anchors.

19. The portable, manual massage device of claim 14, having two external tension-transfer guides wherein said external tension-transfer guides extend from said wrap, said external tension-transfer guides converge into a single external tension-transfer guide, which is in communication with said actuator for retracting said tension-transfer member.

20. The portable, manual massage device of claim 14, wherein said springs are adjacent to said tension-transfer member.

21. The portable, manual massage device of claim 14, wherein the wrap further comprises a protective flap.

22. The portable, manual massage device of claim 14, wherein said wrap is made from soft or semi-soft material, said vertical edges having one or more straight or curved wrap supporters.

* * * * *